US008955611B1

(12) United States Patent
Sharpe

(10) Patent No.: US 8,955,611 B1
(45) Date of Patent: Feb. 17, 2015

(54) CLEAT ANCHORING SYSTEM USEFUL ON HDD RIGS

(71) Applicant: Sharewell HDD, LLC, Spring, TX (US)

(72) Inventor: Forest D. Sharpe, Haslet, TX (US)

(73) Assignee: Sharewell HDD, LLC, Spring, TX (US)

( * ) Notice: Subject to any disclaimer, the term of this patent is extended or adjusted under 35 U.S.C. 154(b) by 0 days.

(21) Appl. No.: 14/165,408

(22) Filed: Jan. 27, 2014

Related U.S. Application Data

(60) Provisional application No. 61/862,505, filed on Aug. 5, 2013.

(51) Int. Cl.
*E21B 7/02* (2006.01)

(52) U.S. Cl.
CPC ..... *E21B 7/02* (2013.01)
USPC ..... 173/84; 52/745.12; 175/57

(58) Field of Classification Search
USPC ..... 52/745.09, 745.1, 745.12; 173/31, 32, 173/37, 38, 42, 45, 184, 186, 187, 189
See application file for complete search history.

(56) References Cited

U.S. PATENT DOCUMENTS 3,930,668 A 1/1976 Schuermann et al.
4,023,828 A 5/1977 MacKenzie et al.
4,953,638 A 9/1990 Dunn
5,231,899 A * 8/1993 Lee ..... 81/57.16
5,253,721 A 10/1993 Lee
5,709,276 A * 1/1998 Lee ..... 175/122
6,131,674 A * 10/2000 Draney et al. ..... 175/122
6,257,350 B1 * 7/2001 Draney et al. ..... 173/32
6,276,464 B1 * 8/2001 Draney et al. ..... 173/32
6,814,161 B1 * 11/2004 Draney et al. ..... 175/19

* cited by examiner

*Primary Examiner* — Brian Glessner
*Assistant Examiner* — Adam Barlow
(74) *Attorney, Agent, or Firm* — Zeman-Mullen & Ford, LLP

(57) ABSTRACT

A cleat anchoring system is disclosed for anchoring a mobile equipment rig using the dead weight of the mobile equipment rig to assist with anchoring. In one embodiment, an anchoring method generally comprises providing front and rear cleat pad assemblies. The rear cleat pad assembly is laid on a ground surface at a first desired position so that cleats on the rear cleat assembly engage the ground surface. The mobile equipment rig is moved to stand on the rear cleat pad assembly. The front cleat pad assembly is then laid on the ground surface at a second desired position so that cleats on the front cleat assembly engage the ground surface. A thrust plate associated with the rig is positioned to stand on the front cleat assembly. The front and rear cleat pad assembles are then rigidly connected.

20 Claims, 5 Drawing Sheets

CLEAT ANCHORING SYSTEM USEFUL ON HDD RIGS

RELATED APPLICATIONS

This application claims the benefit of, and priority to, commonly-invented and commonly-assigned U.S. Provisional Application Ser. No. 61/862,505, filed Aug. 5, 2013.

FIELD OF THE INVENTION

The disclosure of this application is related generally to heavy equipment anchoring systems, and more specifically to a cleat anchoring system that is useful to anchor, for example, a mobile horizontal directional drilling rig.

BACKGROUND

Mobile horizontal directional drilling ("HDD") rigs conventionally include a horizontal directional drilling machine pivotally mounted on a tracked vehicle or tractor. Such mobile rigs generally provide a directional drill bit which is "steerable", and which is mounted on the end of a flexible drill stem. Such a drill is often used for drilling holes, for instance, for installing flexible fiber-optic cable underground, for laying electric cable underground, or similar applications. The fact that the drill is steerable permits a user of the drill to drill under roadways, driveways, sidewalks, and similar, without disrupting the surface. With the conventional drilling machine described above, drilling operations usually are initiated at an angle of approximately 15 degrees to the horizontal. Once the drill bit is underground, it can be steered to drill a passageway of desired azimuth and then withdrawn when the work is completed.

It is necessary to anchor the rig prior to drilling. In addition to drilling torque forces, the drilling operations place push and pull back forces on the rig. These normal drilling forces cause reactionary forces on the rig that urge the rig to uproot or slide along the ground surface, for example. In conventional deployments, an anchor bar extends outwardly from the frame of the tractor and supports anchoring stakes. The anchoring stakes are driven into the support surface in an attempt to stabilize the drilling machine in place during drilling operations.

Larger mobile HDD rigs can deliver over 100,000 pounds of pull back force. Conventional anchoring systems for such larger rigs often further include anchoring piles driven into the ground. The piles may also be cemented. Smaller rigs may be anchored with rotary auger-like stakes driven into the ground with, for example, a hydraulic motor.

A typical anchoring setup has a main body portion which includes a stake-down plate. The stake-down plate is a rectangular metal plate, in which the front and rear long edges of the plate have been bent upwardly to make the stake-down plate have an elongated U-shape in cross-section from front to rear. The stake-down plate has top and bottom smooth surfaces, wherein metal stabilizers are welded to the top surface of the stake-down plate to give it rigidity.

The anchoring assembly also includes stakes which, as noted, can be screwed in or hydraulically driven into the ground or other support surface on which the anchoring assembly is positioned. The stakes may be screwed-in or driven into the support surface so as to be vertical or at an angle to horizontal. The stakes help anchor the anchoring assembly to the support surface in order to resist sliding of the drilling machine during drilling operations.

However, even with the stakes of the stake-down system of the anchoring assembly securely in place in the ground or other support surface, the advancing of the drill bit tends to create a force applied to the drill stem which urges movement of the tracked vehicle drilling machine with respect to the anchoring assembly. Furthermore, when withdrawing the drill bit, there is also a tendency to urge movement of the tracked vehicle drilling machine with respect to the anchoring assembly.

In some drilling applications, it is not possible or desirable to drive the stakes into the ground. The earth may be frozen or there may be electrical cable or similar directly beneath the intended staking location. In these types of situations, the tendency of the drilling machine to slide is particularly troublesome.

The prior art discloses various types of anchoring. U.S. Pat. No. 6,257,350 discloses a multiple-position stake-down assembly positioned beneath the HDD drive head. An anchoring regime is selectable at the stake-down assembly. U.S. Pat. No. 6,131,674 discloses a stake-down assembly positioned beneath the drive head, with additional gripping mechanisms deployed to oppose sliding forces on the stake-down assembly when the HDD rig exerts push and pull back forces. U.S. Pat. No. 5,709,276 discloses a rig anchoring system attached to the front of the rig itself. U.S. Pat. Nos. 5,253,721, 5,231,899 and 4,953,658 disclose conventional stake anchoring systems for smaller rigs. U.S. Pat. No. 4,023,828 discloses a cleat pad for the underneath of outriggers on earthmoving equipment.

All of the foregoing examples of the prior art overlook using the dead weight of the HDD rig itself to hold an anchoring system in the ground. For example, a mobile (track-driven) HDD rig capable of delivering over 100,000 pounds of pull back force may typically have a dead weight of 100,000 pounds itself. It would be advantageous to utilize that dead weight as much as possible to counteract reactionary forces to torque and push/pull back forces encountered during HDD operations. Therefore, there exists a need for an anchoring system that can harness that dead weight and use it to prevent the rig anchors from uprooting or sliding, for example, during push or pull back operations.

SUMMARY AND TECHNICAL ADVANTAGES

The disclosure of this application addresses one or more of the above-described drawbacks of the prior art. Such disclosure includes a cleat anchoring system using the weight of the HDD rig to sit on top of a metal plate with cleats deployed on the underside of the plate. The weight of the rig presses the cleats into the earth and thus discourages the rig from moving or "sliding" in reaction to torsion or pull back forces exerted by the rig during HDD operations. Preferred embodiments deploy cleats in two locations: one in a front position, under the thrust plate (front pad) of the HDD drive, and the other in a rear position under the tracks of the rig. The two sets of cleats, or cleat pads, are joined with connecting rods so that they can act in concert to anchor the HDD rig. In other embodiments, the front and rear cleat pads may be connected with cables or chains. In yet further embodiments, the front and rear cleat pads may be deployed in sections that pin together. In an additional embodiment, a front "bull bar" is also provided attached to the cleat anchoring system, against which the HDD may be braced when reacting to high pull back forces.

It is therefore a technical advantage of the disclosed cleat anchoring system to provide improved anchoring to heavy duty mobile equipment such as an HDD rig. There is a reduced tendency for the HDD rig to uproot or slide, for example, in reaction to torque or push/pull forces exerted during HDD operations.

The disclosed cleat anchoring system, in addition to providing improved anchoring, also provides logistical and environmental advantages over conventional anchoring systems of this type. It is a simple design, enabling rapid set up, tear down and transport from one job to the next. Different sizes and specifications of cleat anchoring systems may easily be devised and customized to suit different types of equipment being used in different anchoring environments. The disclosed cleat anchoring system is much less disruptive to the local earth and soil environment than comparable conventional systems that might require heavy-duty augers and/or cement piles to provide the required anchoring.

A further technical advantage is that setup, use, tear down and transportation of the disclosed cleat anchoring system should provide significant savings of time and money over comparable conventional anchoring systems.

A further technical advantage is increased safety for personnel working in and around the HDD rig.

In another embodiment of the disclosed cleat anchoring system, optional plates may be provided around the front and rear cleat pads, to which the cleat pads may be attached by, for example, conventional bolting. Further side rails may be provided framing the cleat pads. These additional optional plates may allow the disclosed cleat anchoring system also to capture fluids that may issue from the HDD rig, such as hydraulic oil or drilling fluids. Conventionally, a user has to put down tarpaulins or other protection to prevent these fluids from spilling into the soil. A technical advantage of these optional plates is to protect the soils surrounding the HDD rig without having to put down tarpaulins.

The, foregoing has outlined rather broadly the features and technical advantages of the disclosure of this application, in order that the detailed description of the embodiments that follows may be better understood. It will be appreciated by those skilled in the art that the specific embodiments disclosed may be readily utilized as a basis for modifying or designing other structures for carrying out the same general purposes of the material set forth in this disclosure.

BRIEF DESCRIPTION OF THE DRAWINGS

For a more complete understanding of embodiments described in detail below, and the advantages thereof, reference is now made to the following drawings, in which.

DETAILED DESCRIPTION

Figure 1:
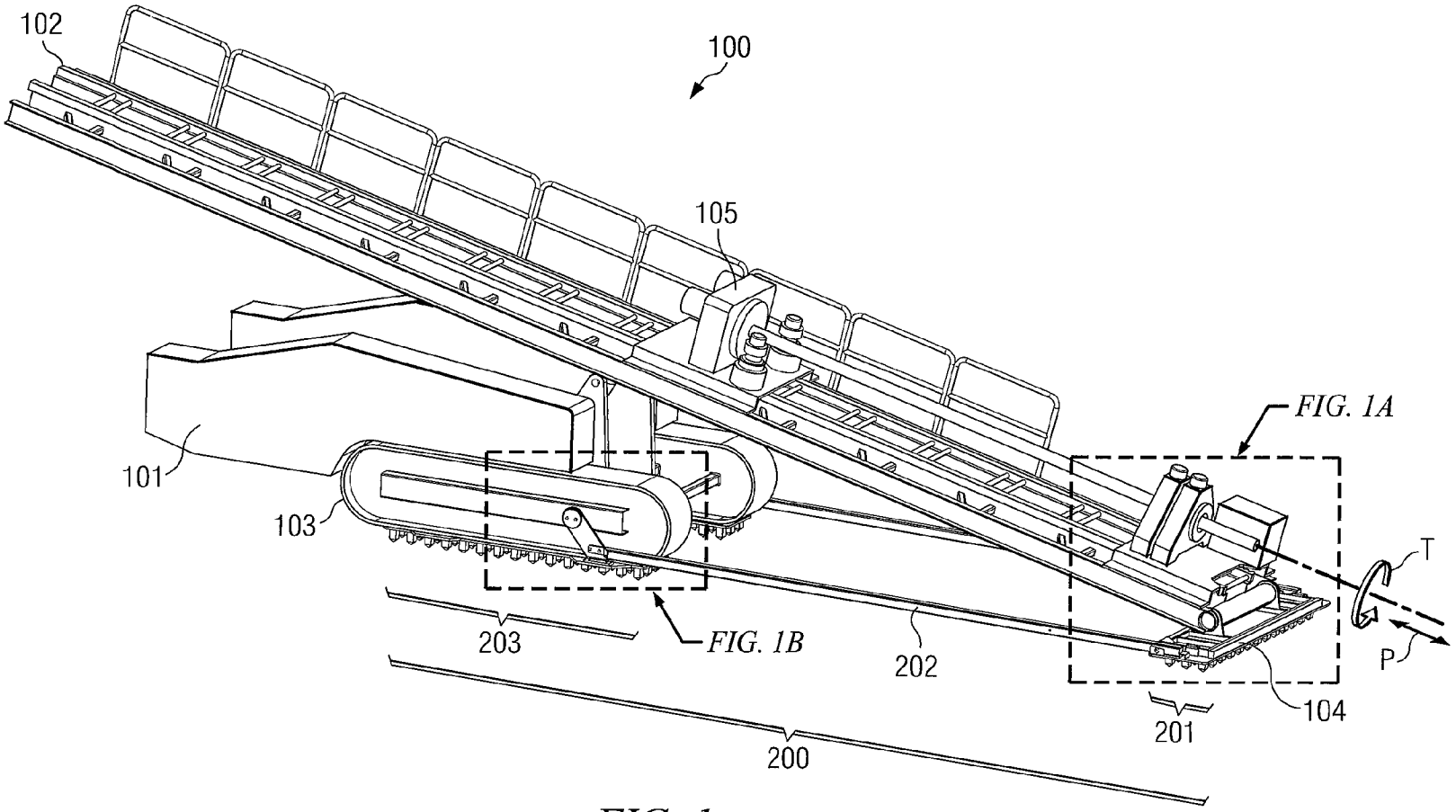
FIG. 1 depicts a general arrangement of one embodiment of the disclosed cleat anchoring system 200 deployed on an exemplary HDD rig 100.

FIG. 1 depicts a general arrangement of one embodiment of cleat anchoring system 200 deployed on HDD rig 100. As illustrated on FIG. 1, HDD rig 100 follows the general example of a model DD-440T by American Augers. However, it will be appreciated that HDD rig 100 may be any suitable equipment. FIG. 1 illustrates HDD rig 100 as including tractor 101, tractor tracks 103, drive carriage 102, front thrust plate 104 and rotary drive 105.

As further shown on FIG. 1, rotary drive 105 generates drilling forces to enable pipe joints to be drilled into or pulled out of the ground at the desired angle. Of particular (but not exclusive) interest to cleat anchoring system 200 are torque forces T and push/pull back forces P (as illustrated on FIG. 1). It will be understood that these drilling forces create reactionary forces on HDD rig 100 which urge HDD rig 100 to uproot or to slide, for example, Cleat anchoring system 200 resists these reactionary forces to help keep HDD rig substantially motionless and stable.

With continued reference to FIG. 1, cleat anchor system 200 includes front cleat pad 201 and rear cleat pads 203 joined rigidly together by connecting rods 202. Note that on FIG. 1, only the near side rear cleat pad 203 and connecting rod 202 are labeled. It will be easily seen and understood from FIG. 1 that a corresponding rear cleat pad 203 and connecting rod 202 are also provided on the far side. Rigid connection via connecting rods 202 enables front cleat pad 201 and rear cleat pads 203 to work together in concert to anchor HDD rig 100. Connecting rods 202 may be made from any suitable material, such as steel, and may have any suitable profile, such as bars, rods, or structural members.

Figure 2:
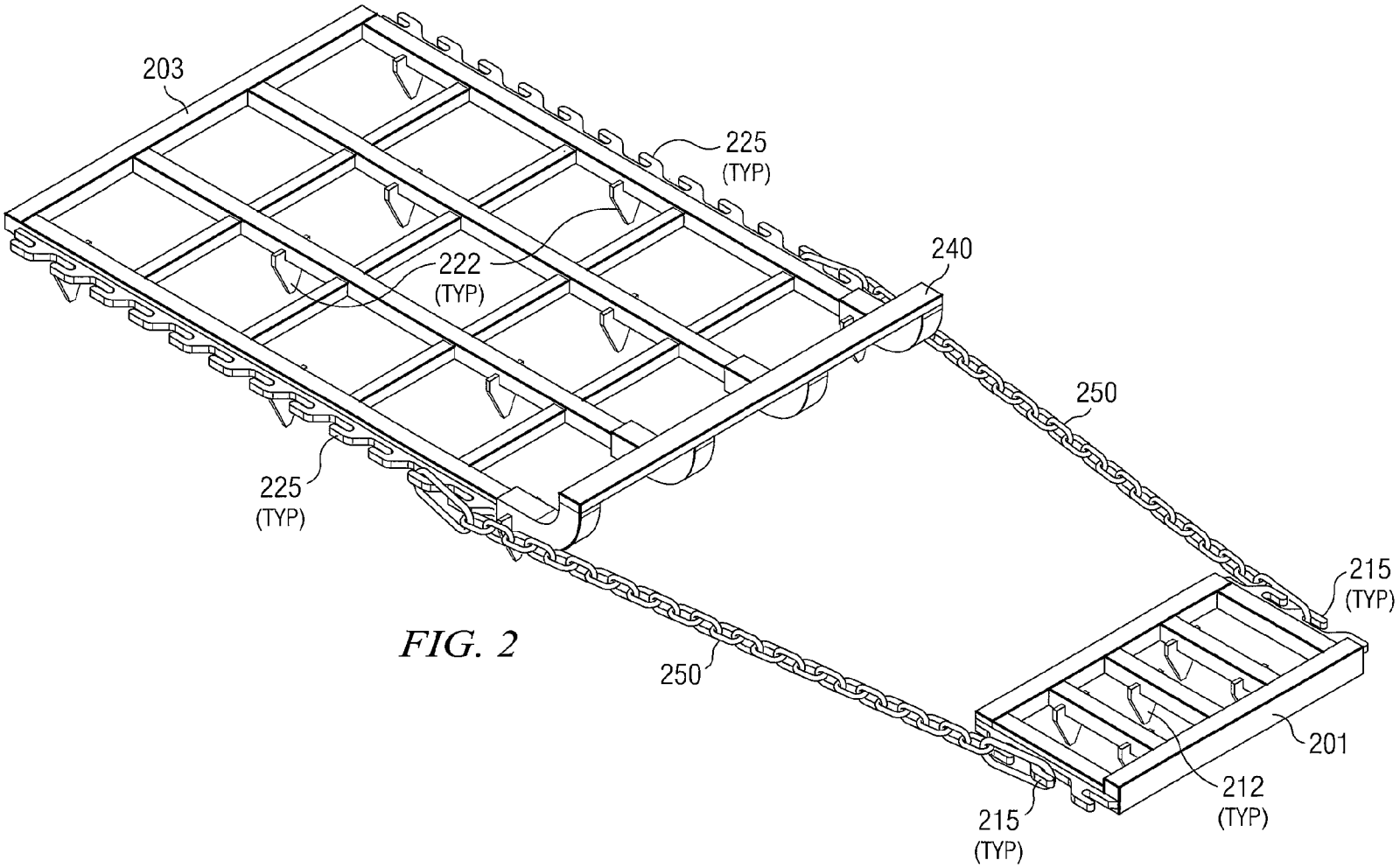
FIG. 2 depicts a second embodiment of the disclosed anchoring system without the exemplary HDD rig.

In other embodiments (illustrated by example in FIG. 2), cables or chains may be substituted for connecting rods 202. In such embodiments, the cables or chains run between front and rear cleat pads 201 and 203 to keep them from separating. With tractor 101 rigidly attached to rear cleat pad 203 and butted tight up to a front bull bar, and front thrust plate 104 of the HDD rig and rigidly attached to front cleat pad 201 butted up tight to a front bull bar, tension may be applied to the cables/chains. The tensioned cables/chains will have the same effect as connecting rods 202 as disclosed on FIG. 1. The exemplary embodiments illustrated in FIG. 2 are discussed further below.

Figure 1A:
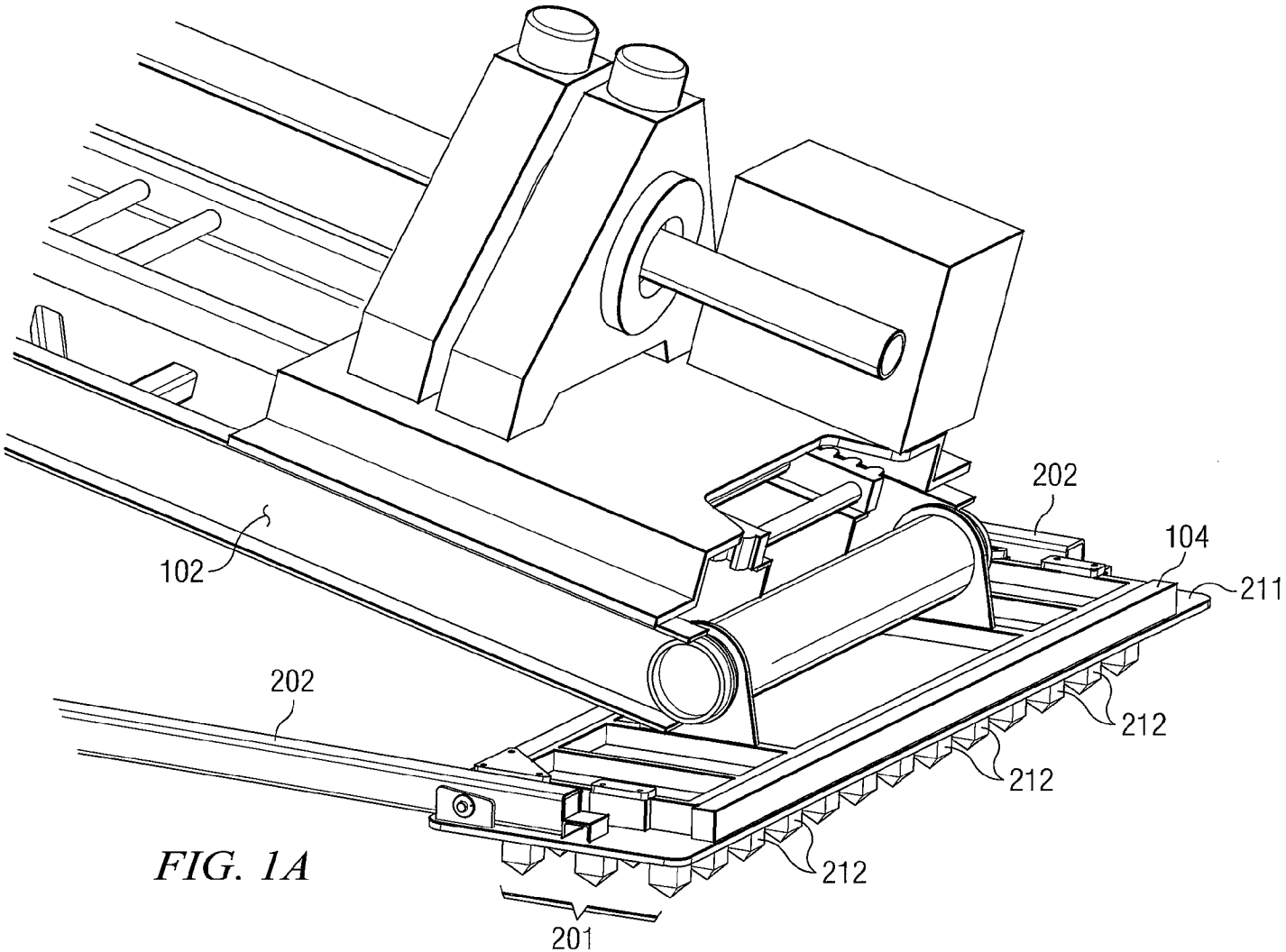
FIG. 1A is an enlargement of details on the front thrust plate 104 of the HDD rig 100 depicted on FIG. 1.

FIG. 1A is an enlargement of details on or around front thrust plate 104 of HDD rig 100 as depicted on FIG. 1. Items depicted on multiple FIGURES throughout this disclosure have the same part numbers on each FIGURE where they appear. It will be seen on FIG. 1A that front cleat pad 201 comprises front cleat plate 211 and front cleats 212. Front cleat plate 211 may be made from any suitable material (such as steel) of any suitable thickness. Likewise, front cleats 212 may be made from any suitable material (again such as steel), and may be any suitable cross-sectional size, length or profile. Front cleat plate 211 may also be of any suitable or desired size. In FIG. 1A, it will be seen that the illustrated embodiment depicts front cleat plate 211 generally conforming to the size of front thrust plate 104. This disclosure is not limited in this regard, however. Front cleats 212 are rigidly attached to front cleat plate 211 by any suitable method, such as welding. In embodiments where front cleats 212 might be desired to be intentionally replaceable, front cleats 212 may also be attached to front cleat plate 211 by fasteners such as bolts. Front cleats 212 may be attached to front cleat plate 211 in any desired spacing or pattern. Different shapes or lengths of front cleats 212 may be mixed in a desired spacing or pattern.

It will be thus appreciated from FIG. 1A, and FIGS. 3A through 3D, that multiple designs of front cleat pad 201 are available, choosing from among, for example, the design variables for front cleat plate 211 and front cleats 212 discussed in the previous paragraph. Designs of front cleat pad 201 may be selected for particular applications and surfaces in which anchoring is desired (for example, wet or dry surfaces, hard or soft surfaces, solid or grainy surfaces, etc.)

With reference now to FIGS. 3A through 3D, four exemplary embodiments of designs for front cleat pad 201 are illustrated, deploying various styles of front cleats 212 in various patterns, lengths and three-dimensional profiles. It will be understood that nothing in this disclosure should be interpreted, however, to limit the possible designs for front cleat pad 201 to those illustrated in FIGS. 3A through 3D. It will also be noted in FIGS. 3A through 3D, embodiments are illustrated including cable/chain hooks 215, consistent with the embodiments of FIG. 2 rather than the embodiments using connecting rods 202 as illustrated on FIG. 1. The cleat designs in FIGS. 3A through 3D are not limited in this regard, however. It will be further understood that the designs for front cleat pad 201 on FIGS. 3A through 3D are suitable for any structure by which front cleat pad 201 is connected to rear cleat pads 203.

Figure 3B:
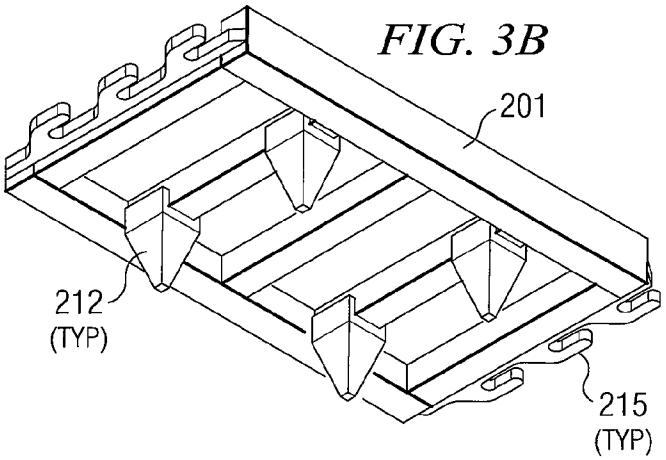
FIGS. 3A through 3D illustrate, from the underside, exemplary embodiments of different cleat patterns and different three-dimensional cleat profiles.
Figure 3A:
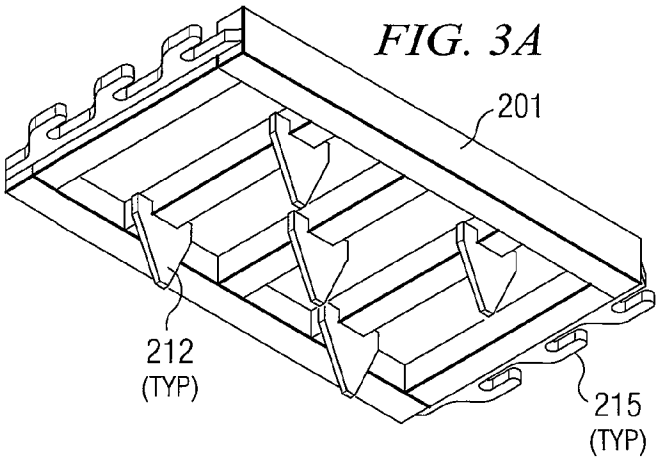
Figure 3D:
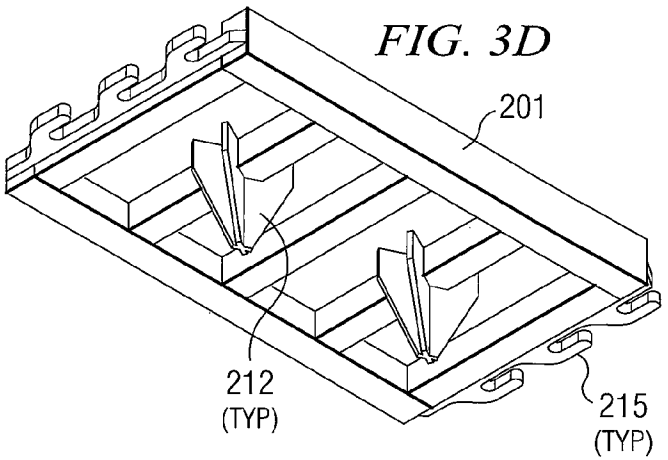
Figure 3C:
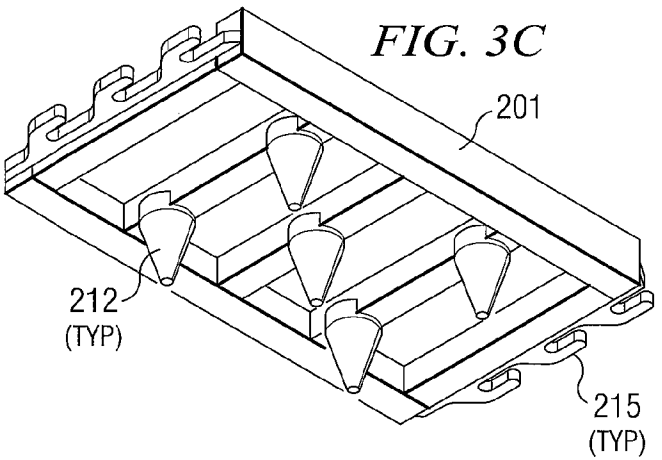

FIG. 3A illustrates front cleats 212 in an offset pattern, in which front cleats 212 are a planar shape sharpened to a point. FIG. 3B illustrates front cleats 212 in an aligned pattern, in which front cleats 212 are a square profile sharpened to a point. FIG. 3C illustrates front cleats 212 in an offset pattern, in which front cleats 212 are a cone shape. FIG. 3D illustrates front cleats 212 in an aligned pattern, in which front cleats are an 'X' profile sharpened to a point.

With momentary reference to FIG. 2, it will be appreciated that the exemplary designs for front cleats 212 on front cleat pad 201 (including pattern, length and three-dimensional profile) are analogously applicable to illustrate exemplary designs for rear cleats 222 on rear cleat pads 203. The disclosure of the two immediately preceding paragraphs is analogously applicable in all regards to rear cleats 222 on rear cleat pads 203.

Returning now to FIGS. 1, 1A and 1B, FIG. 1A further shows that connecting rods 202 are rigidly, but removably, attached to front cleat plate 211. As noted above with reference to FIG. 1, rigid attachment via connecting rods 202 enables front cleat pad 201 and rear cleat pads 203 (not illustrated on FIG. 1A) to work together in concert to anchor HDD rig 100. Removable attachment facilitates setup, tear down and transport of cleat anchoring system 200. Removable attachment may be by any suitable conventional means, such as bolts or similar fasteners.

Figure 1B:
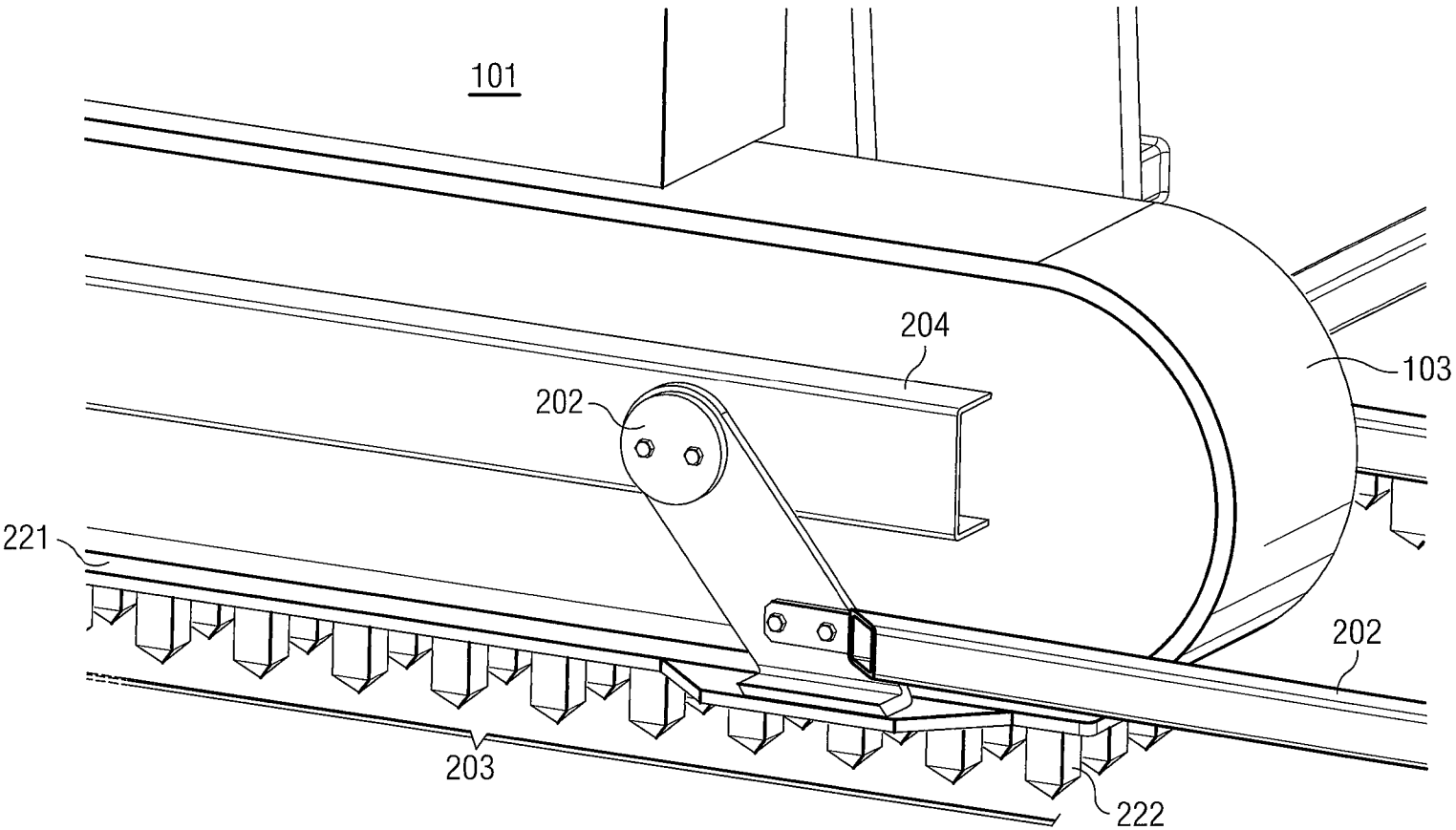
FIG. 1B is an enlargement of details on or around the front of the tractor tracks 103 on the HDD rig 100 depicted in FIG. 1.

FIG. 1B is an enlargement of details on or around the front of the tractor tracks on the HDD rig depicted in FIG. 1. Items depicted on both FIGS. 1 and 1B have the same part numbers. Referring to FIG. 1B, rear cleat pad 203 includes rear cleat plate 221 and rear cleats 222. Tractor 101 provides structural member 204 attached near tracks 103 (for example, by welding). Lug 205 rigidly (but removably) attaches structural member 204 (and thus tractor 101) to rear cleat plate 221 and connecting rod 202. The rigid but removable attachment may be by any suitable method, such as bolts or other fasteners. It will be understood that in some embodiments, structural member 204 and lug 205 may be omitted, and connecting rod 202 may be rigidly (but removably) attached directly to rear cleat plate 221.

As noted above, the disclosure above with reference to front cleat plate 211 and front cleats 212 on FIG. 1A and FIGS. 3A through 3D is analogously applicable to rear cleat plate 221 and rear cleats 222 illustrated on FIG. 1B. Rear cleat plate 221 may be made from any suitable material (such as steel) of any suitable thickness. Likewise, rear cleats 222 may be made from any suitable material (again such as steel), and may be any suitable cross-sectional size, length or profile. Rear cleat plate 221 may also be of any suitable or desired size. In FIG. 1B, it will be seen that the illustrated embodiment depicts rear cleat plate 221 generally conforming to the size of tractor track 103. This disclosure is not limited in this regard, however. Rear cleats 222 are rigidly attached to rear cleat plate 221 by any suitable method, such as welding. In embodiments where rear cleats 222 might be desired to be intentionally replaceable, rear cleats 222 may also be attached to rear cleat plate 221 by fasteners such as bolts. Rear cleats 222 may be attached to rear cleat plate 221 in any desired spacing or pattern. Different shapes or lengths of rear cleats 222 may be mixed in a desired spacing or pattern.

It will be thus appreciated from FIG. 1B (and FIGS. 3A through 3D by analogy) that multiple designs of rear cleat pad 203 are available, choosing from among, for example, the design variables for rear cleat plate 221 and front cleats 222 discussed in the previous paragraphs. Designs of rear cleat pad 203 may be selected for particular applications and surfaces in which anchoring is desired (for example, wet or dry surfaces, hard or soft surfaces, solid or grainy surfaces, etc.)

It will also be appreciated that the disclosure above with reference to FIG. 1B is directed generally to features associated with a rear cleat pad 203 beneath tractor track 103 on the near side, as drawn, on FIG. 1. As noted above with respect to FIG. 1, however, a rear cleat pad 203 is also provided beneath tractor track 103 on the far side, as drawn on FIG. 1, and a far side connecting rod 202 rigidly connects the far side rear cleat pad 203 to front cleat pad 201.

It will be further understood that rear cleat pads 203 may be of a unitary design, or of differing designs, per user selection. Rear cleat pads 203 may also be rigidly (but removably) connected across or under tractor 101 in analogous fashion to connecting rods 202 connecting front and rear cleat pads 201 and 203. Rear cleat pads 203 may also, in some embodiments, be a single rear cleat pad 203 spanning the underside of tractor 101 from track 103 to track 103, such as is illustrated on FIG. 2. The ability of cleat anchoring system 200 as a whole to anchor HDD rig 100 may be enhanced in embodiments providing a single rear cleat pad 203 or connected rear cleat pads 203.

FIG. 2 illustrates alternative exemplary embodiments of front and rear cleat pads 201 and 203. Rear cleat pad 203 on FIG. 2 is illustrated in a unitary structure (as opposed to the two separate rear cleat pads 203 illustrated on FIG. 1). FIG. 2 further illustrates front and rear cleat pads 201 and 203 with cable/chain hooks 215 provided, and connected together with chains 250 (although cables may be substituted for the chains). Rear cleat pad 203 further provides front bull bar 240. Front cleat pad 201 may also provide a rear bull bar, which has been omitted from FIG. 2 for clarity. The integrated function of chains 250 (or cables) together with front and rear cleat pads 201 and 203 as illustrated on FIG. 2 is described in more detail in the following paragraph.

Looking at all the FIGURES as a whole, an exemplary method for setting up cleat anchoring system 200 would comprise several steps. First, front and rear cleat pads 201 and 203 are laid out to their desired position. Tractor 101 is then reversed up over front cleat pad 201 and on to its rear cleat pads 203. The dead weight of tractor 101 may thus be used to anchor both front and rear cleat pads 201 and 203 into the ground. Tractor 101 and front thrust plate 104 are anchored to their respective cleat pads (rear and front) 203 and 201. In the embodiments of FIGS. 1, 1A and 1B, connecting rods 202 are then installed and rigidly bolted down as disclosed above. Alternatively, in the embodiments of FIG. 2, chains 250 (or cables) may be used to connect front and rear cleat pads 201 and 203. In such embodiments, once tractor 101 is standing on rear cleat pad 203, it may be butted up against front bull bar 240. Thrust plate 104 may similarly be butted up against rear bull bar on front cleat pad 201 (rear bull bar omitted on FIG. 2 for clarity). Chains 250 (or cables) may then be installed using chain/cable hooks 251, and tightened so that front cleat pad 201 is restrained from separating from rear cleat pad 203.

The cleat anchoring system 200 has been described throughout so far with reference to an HDD rig 100. The cleat anchoring system is not limited in this regard, however, and could be used to stabilize and anchor other equipment, such as, without limitation, auger boring machines, pipe thrusters on pipe line jobs, and in deployments on pipe jacking and recovery situations. A recovery situation might require adding a winch onto the cleat anchoring system.

The variety of applications of the disclosed cleat anchoring system further suggests various alternative embodiments (not illustrated herein). In lighter duty applications, some or all of the connecting rods or cables/chains could be omitted. Alternatively, the front and rear cleat pads may be deployed in sections that pin together. In heavier duty applications, front and rear cleat pads 201 and 203 (as shown on FIG. 1) could be further anchored with stakes, for example. Obviously, such additional anchoring would likely increase the setup and tear down time for the disclosed cleat anchoring system. However, such additional anchoring by stakes, for example, would be preferable to piling in applications where a further-anchored cleat system was comparable in performance to piling.

As also described above in the "Summary" section, a further embodiment of the disclosed cleat anchoring system (not illustrated) may provide optional plates around front and rear cleat pads 201 and 203 (as shown on FIG. 1), to which the cleat pads may be attached by, for example, conventional bolting. Further side rails may be provided framing the cleat pads. These additional optional plates may allow the disclosed cleat anchoring system also to capture fluids that may issue from the HDD rig, such as hydraulic oil or drilling fluids.

Although the inventive material in this disclosure has been described in detail along with some of its technical advantages, it will be understood that various changes, substitutions and alternations may be made to the detailed embodiments without departing from the broader spirit and scope of such inventive material.

I claim:

1. A method for anchoring a mobile equipment rig having a dead weight, the method using the dead weight of the mobile equipment rig to assist with anchoring, the method comprising the steps of:

(a) providing front and rear cleat pad assemblies, each cleat pad assembly comprising at least one generally planar pad plate, each pad plate having upper and lower sides, each pad plate further comprising a plurality of cleats attached to the lower side thereof, the cleats attached to the pad plates according to a selected pattern for each pad plate; each cleat having a selected vertical length and a selected three-dimensional profile;

(b) laying the rear cleat pad assembly on a ground surface at a first desired position so that cleats on the rear cleat assembly engage the ground surface;

(c) moving the mobile equipment rig to stand on the rear cleat pad assembly;

(d) laying the front cleat pad assembly on the ground surface at a second desired position so that cleats on the front cleat assembly engage the ground surface;

(e) positioning a thrust plate associated with the mobile equipment rig to stand on the front cleat assembly; and (f) rigidly connecting the front cleat pad assembly to the rear cleat pad assembly.

2. The method of claim 1, in which the mobile equipment rig comprises a mobility mode selected from the group consisting of: (1) tracks and (2) wheels.

3. The method of claim 1, in which the mobile equipment includes two parallel tracks, and in which the rear cleat pad assembly comprises a configuration selected from the group consisting of:

(1) a unitary pad plate in step (a) on which both tracks of the mobile equipment rig stand in step (c); and (2) two pad plates in step (a) rigidly connected together, the two pad plates configured so that each of the mobile equipment rig tracks stands in step (c) on a different pad plate.

4. The method of claim 1, in which step (f) further comprises rigidly connecting the front cleat pad assembly to the rear cleat pad assembly with connector rods.

5. The method of claim 4, in which the mobile equipment rig comprises two parallel tracks, and in which step (f) further comprises also rigidly connecting the front cleat pad assembly to the mobile equipment tracks with the connector rods.

6. The method of claim 1, further comprising:

(g) driving stakes into the ground surface; and (h) rigidly connecting one of the front cleat pad assembly and the rear cleat pad assembly to selected ones of the stakes.

7. The method of claim 1, further comprising:

(1) further providing a front bull bar on the front cleat pad assembly and a rear bull bar on the rear cleat pad assembly in step (a);

(2) laying the rear cleat pad assembly in step (b) and laying the front cleat pad assembly in step (d) such that the front bull bar opposes the rear bull bar;

(3) butting the mobile equipment rig against the rear bull bar in step (c) and, butting the thrust plate against the front bull bar in step (e); and (4) rigidly connecting the front cleat pad assembly to the rear cleat pad assembly in step (f) via connectors selected from the group consisting of (i) cables and (ii) chains, such that the front cleat pad assembly is restrained from separating from the rear cleat pad assembly.

8. The method of claim 1, in which, in step (a), the selected pattern according to which the cleats are attached to the pad plate on one of the front and rear cleat assemblies includes a plurality of rows of cleats in which alternate rows are offset.

9. The method of claim 1, in which, in step (a), at least one cleat has a three-dimensional profile selected from the group consisting of:

(1) a cone shape;

(2) a square profile sharpened to a point;

(3) a planar shape sharpened to a point; and (4) an 'X' profile sharpened to a point.

10. The method of claim 1, in which, in step (a), selected ones of the cleats are replaceable.

11. The method of claim 1, in which step (f) comprises rigidly connecting the front cleat pad assembly to the rear cleat pad assembly with sections that pin together.

12. The method of claim 1, in which one of the front or rear cleat pad assemblies in step (a) further comprises at least one fluid collection assembly attached thereto and operable to collect fluids that issue from the mobile equipment rig.

13. A method for anchoring a mobile equipment rig having a dead weight, the method using the dead weight of the mobile equipment rig to assist with anchoring, the mobile equipment rig including two parallel tracks, the method comprising the steps of:

(a) providing front and rear cleat pad assemblies, each cleat pad assembly comprising at least one generally planar pad plate, each pad plate having upper and lower sides, each pad plate further comprising a plurality of cleats attached to the lower side thereof, the cleats attached to the pad plates according to a selected pattern for each pad plate; each cleat having a selected vertical length and a selected three-dimensional profile;

(b) laying the rear cleat pad assembly on a ground surface at a first desired position so that cleats on the rear cleat assembly engage the ground surface;

(c) moving the mobile equipment rig to stand on the rear cleat pad assembly;

(d) laying the front cleat pad assembly on the ground surface at a second desired position so that cleats on the front cleat assembly engage the ground surface;

(e) positioning a thrust plate associated with the mobile equipment rig to stand on the front cleat assembly;

(f) rigidly connecting the front cleat pad assembly to the rear cleat pad assembly with connector rods, and further rigidly connecting the front cleat pad assembly to the mobile equipment tracks with the connector rods.

14. The method of claim 13, in which the rear cleat pad assembly comprises a configuration selected from the group consisting of:

(1) a unitary pad plate in step (a) on which both tracks of the mobile equipment rig stand in step (c); and (2) two pad plates in step (a) rigidly connected together, the two pad plates configured so that each of the mobile equipment rig tracks stands in step (c) on a different pad plate.

15. The method of claim 13, further comprising:

(g) driving stakes into the ground surface; and (h) rigidly connecting one of the front cleat pad assembly and the rear cleat pad assembly to selected ones of the stakes.

16. The method of claim 13, in which, in step (a), the selected pattern according to which the cleats are attached to the pad plate on one of the front and rear cleat assemblies includes a plurality of rows of cleats in which alternate rows are offset.

17. The method of claim 13, in which, in step (a), at least one cleat has a three-dimensional profile selected from the group consisting of:

(1) a cone shape;

(2) a square profile sharpened to a point;

(3) a planar shape sharpened to a point; and (4) an 'X' profile sharpened to a point.

18. The method of claim 13, in which, in step (a), selected ones of the cleats are replaceable.

19. The method of claim 13, in which one of the front or rear cleat pad assemblies in step (a) further comprises at least one fluid collection assembly attached thereto and operable to collect fluids that issue from the mobile equipment rig.

20. A method for anchoring a mobile equipment rig having a dead weight, the method using the dead weight of the mobile equipment rig to assist with anchoring, the method comprising the steps of:

(a) providing front and rear cleat pad assemblies, each cleat pad assembly comprising at least one generally planar pad plate, each pad plate having upper and lower sides, each pad plate further comprising a plurality of cleats attached to the lower side thereof, the cleats attached to the pad plates according to a selected pattern for each pad plate; each cleat having a selected vertical length and a selected three-dimensional profile;

(b) laying the rear cleat pad assembly on a ground surface at a first desired position so that cleats on the rear cleat assembly engage the ground surface;

(c) moving the mobile equipment rig to stand on the rear cleat pad assembly;

(d) laying the front cleat pad assembly on the ground surface at a second desired position so that cleats on the front cleat assembly engage the ground surface;

(e) positioning a thrust plate associated with the mobile equipment rig to stand on the front cleat assembly; and (f) rigidly connecting the front cleat pad assembly to the rear cleat pad assembly via a connection mode selected from the group consisting of: (1) cables, (2) chains, and (3) sections that pin together.

* * * * *